US006594938B2

(12) United States Patent
Horton

(10) Patent No.: US 6,594,938 B2
(45) Date of Patent: Jul. 22, 2003

(54) FRONT INTERFACING DETACHABLE SCOPE MOUNT

(76) Inventor: John Wiley Horton, 430 Satsuma Ave., Monticello, FL (US) 32344

( * ) Notice: Subject to any disclaimer, the term of this patent is extended or adjusted under 35 U.S.C. 154(b) by 0 days.

(21) Appl. No.: 09/963,852

(22) Filed: Sep. 26, 2001

(65) Prior Publication Data

US 2003/0056417 A1 Mar. 27, 2003

(51) Int. Cl.[7] ..... F41G 1/387

(52) U.S. Cl. ..... 42/127; 42/72; 42/90; 42/124; 42/125; 42/126; 42/141; 42/111; 89/37.04; 89/37.09; 89/37.13; 89/37.16

(58) Field of Search ..... 42/72, 90, 124, 42/125, 126, 127, 111, 141; 89/37.04, 37.09, 37.13, 37.16

(56) References Cited

U.S. PATENT DOCUMENTS

| | | | | | |
|---|---|---|---|---|---|
| 2,641,057 | A | * | 6/1953 | Moore | 42/125 |
| 2,854,748 | A | * | 10/1958 | Williams | 42/126 |
| 3,187,435 | A | * | 6/1965 | Miller, Jr. | 42/126 |
| 3,463,430 | A | * | 8/1969 | Rubin et al. | 248/229.15 |
| 3,634,963 | A | * | 1/1972 | Hermann | 42/70.11 |
| 3,877,166 | A | * | 4/1975 | Ward | 42/127 |
| 4,147,220 | A | * | 4/1979 | Swiderski et al. | 173/170 |
| 4,205,473 | A | * | 6/1980 | Wilson | 42/127 |
| 4,249,315 | A | * | 2/1981 | Hopson, III | 42/125 |
| 4,291,476 | A | * | 9/1981 | Repa | 42/124 |
| 4,571,870 | A | * | 2/1986 | Heideman et al. | 42/1.01 |
| 4,776,126 | A | * | 10/1988 | Williams | 42/125 |
| 5,035,487 | A | * | 7/1991 | Herz | 359/811 |
| 5,390,419 | A | * | 2/1995 | Sirkis | 42/127 |
| 5,396,725 | A | * | 3/1995 | Talbot | 42/127 |
| 5,531,039 | A | * | 7/1996 | Gore | 42/124 |
| 5,813,131 | A | * | 9/1998 | Werre | 33/533 |
| 5,941,006 | A | * | 8/1999 | Horton | 42/124 |
| 6,250,008 | B1 | * | 6/2001 | Silver | 42/70.01 |
| 6,269,577 | B1 | * | 8/2001 | Hardy | 42/127 |
| 6,295,751 | B1 | * | 10/2001 | Piwonski | 42/1.15 |
| 6,318,015 | B1 | * | 11/2001 | Baumann et al. | 42/111 |
| 6,427,374 | B1 | * | 8/2002 | Vaiani | 42/85 |

FOREIGN PATENT DOCUMENTS

| | | | |
|---|---|---|---|
| WO | WO 99/63295 | * | 12/1999 |

* cited by examiner

*Primary Examiner*—Michael J. Carone
*Assistant Examiner*—John Richardson
(74) *Attorney, Agent, or Firm*—J. Wiley Horton

(57) ABSTRACT

A detachable mount for a telescopic sight which can be operated using only one latching mechanism. The mount uses a front base attached to the ring of a rifle receiver and a rear base attached to the bridge of a rifle receiver. The upper surfaces of both the front and rear bases open into a pair of slots. A separate scope mount is attached to a scope sight by conventional means. Two sets of lugs descend from the lower surfaces of this scope mount. These sets of descending lugs are configured to fit securely within the slots in the front and rear bases when the scope mount is placed over the bases. The forward facing surfaces of the rear set of descending lugs mate with a corresponding set of rearward facing surfaces in the slots within the rear base. These sets of mating surfaces are offset from the vertical to create a wedging effect that pulls the rear of the scope mount down when it is pushed forward relative to the rifle receiver. The rearward facing surfaces of the front set of descending lugs open into tapered notches. The front base incorporates a transverse slider having a tapered surface which fits within the tapered notches in the front descending lugs. The interaction of this slider with the front lugs pushes the front of the scope mount forward while simultaneously pulling it down. The forward motion also serves to pull the rear of the scope mount down as described previously.

14 Claims, 18 Drawing Sheets

FRONT INTERFACING DETACHABLE SCOPE MOUNT

CROSS-REFERENCES TO RELATED APPLICATIONS

Not Applicable.

STATEMENT REGARDING FEDERALLY SPONSORED RESEARCH OR DEVELOPMENT

Not Applicable.

MICROFICHE APPENDIX

Not Applicable.

BACKGROUND OF THE INVENTION

1. Field of the Invention

This invention relates to the field of telescopic sights for firearms. More specifically, the invention comprises a detachable mount for a telescopic sight that can be detached using one hand without adjusting the customary grip on the firearm.

2. Description of the Related Art

Detachable mounts for telescopic sights have been in use for approximately one century, owing to a long-recognized need. Firearms, particularly sporting rifles, are relatively durable items capable of withstanding wide variations in atmospheric conditions and substantial physical shock. Telescopic sights, in contrast, are relatively delicate optical instruments. Although their design has been advanced considerably in recent decades, telescopic sights remain vulnerable to variations in atmospheric conditions and to physical shock. A sharp blow to a telescopic sight will often shift its point of aim. Worse, there is no visual indicator of this shift, meaning that the user is often unaware of the shift until a shot is fired and missed.

As a result of these factors, hunting rifles with permanently attached telescopic sights must be treated delicately. It has therefore long been recognized that the ability to detach the telescopic sight until it is needed is highly desirable. One such type of detachable mount is disclosed in U.S. Pat. No. 5,035,487 to Herz (1991). While effective, the Herz type of device is slow to operate. The user must hold the rifle securely while using his or her free hand to rotate the small levers employed to engage the scope mounts. These levers do not provide much mechanical advantage. Both must be rotated independently to the correct position. The telescopic sight must then be lifted off without tilting—or the device tends to become stuck.

In hunting situations, the telescopic sight must often be removed rapidly. This is particularly true when following up wounded game. In such close range work, the use of the open (sometimes called "iron") sights on the rifle is generally preferred. Thus, a scope which could be removed quickly using a single latching device is preferable.

The Herz device also incorporates the interaction of camming surfaces generating high surface friction. There is no accommodation for wear compensation. Thus, as the device is used over time, the interlocking surfaces tend to wear loose—eventually rendering the device inoperable.

One type of detachable mount using a single latching device is known as the "European claw." This type of mount dates back to approximately World War I. Printed sources within the art sometimes refer to this type of mount as a "Suhler" mount. Though the Applicant is unable to verify the origins of this name, one would assume that "Suhler" refers to the individual who originally created the design.

The Suhler mount is relevant to the consideration of the present invention. As the Applicant is unable to discover a prior patent disclosing the details of the Suhler design, the Applicant is submitting the details herewith. FIG. 1 illustrates the prior art Suhler mount. Rifle receiver 10 is of the common bolt-action type. Barrel 12 is threaded into rifle receiver 10. Rifle receiver 10 has a forward cylindrical portion referred to as receiver ring 22, and a rear portion referred to as receiver bridge 24. The particular receiver illustrated is of the Mauser type, which is the rifle type most closely associated with the Suhler mount.

In preparation to installing the Suhler mounts, dovetail cut 44 is milled into receiver ring 22. Front Suhler base 46 is then press-fit laterally into front dovetail cut 44. In some instances, it may also be soldered in place. The reader will observe that the upper planar surface of front Suhler base 46 opens into two front Suhler slots 50.

Rear Suhler base 48 is installed on receiver bridge 24 in one of two ways. Some receiver bridges have an upstanding lug into which a lateral dovetail cut can be made. If this is the case, then rear Suhler base 48 is press fit into place (and possibly soldered) in the same fashion as for front Suhler base 46. Other receiver bridges have only a rounded cylindrical surface that is too thin to accommodate a dovetail cut. In that case, rear Suhler base 48 is soldered onto the top of the receiver bridge in an operation obviously requiring considerable skill and precision. Rear Suhler base 48 has a pair of rear Suhler slots 52.

At the time the Suhler design was created the object was to mount old scope sight 56. FIG. 2 shows such a telescopic sight. Old scope sight 56 is a type of telescopic sight which is now rarely seen, but was once quite common. The reader will note that it consists primarily of a long featureless cylinder having a relatively small diameter (typically one inch or 30 mm). Only the eyepiece has a larger diameter. Modern scopes have a much larger objective lens (the forward lens) diameter. The significance of this difference will become apparent subsequently.

Still referring to FIG. 2, the reader will note that rear ring 60 and front ring 58 are attached to old scope sight 56. These are typically positioned on old scope sight 56 and soldered in place. Rear ring 60 has two descending rear Suhler lugs 64. The rearward facing surfaces of these two lugs are each cut by Suhler mating notches 68.

Front ring 58 has two descending front Suhler lugs 62. The forward facing surfaces of these two lugs are angled to form mating surfaces 66. FIG. 3 shows rifle receiver 10 with old scope sight 56 in place. The figure incorporates a cutaway through both the front and rear Suhler bases to show the internal features of the nearest set of Suhler slots. The reader will observe that front Suhler lug 62 rests within front Suhler slot 50, and rear Suhler lug 64 fits within rear Suhler slot 52.

Suhler slider 54 is biased—typically by springs—to move forward (right to left in the view as shown). Returning briefly to FIG. 1, the ends of Suhler slider 54 actually extend out beyond the sides of rear Suhler base 52. A tab is attached to each exposed end to facilitate grasping by the user. These tabs are actually identified as Suhler slider 54 in FIG. 1.

Returning now to FIG. 3, the operation of the devie will be described. When the user releases the tabs, Suhler slider 54 is pushed forward where it engages mating notch 68. This interface prevents any vertical motion of rear ring 60, and also pushes the entire assembly of the scope and rings forward. That forward motion brings mating surfaces 66 on front Suhler lugs 62 in contact with corresponding surfaces on front Suhler slots 50 (the rearward facing surfaces). The reader will observe that these mating surfaces are inclined from the vertical. The result is a wedge interaction—with front ring 58 being pulled firmly down as it is forced forward. When the mating surfaces are fully engaged, any further forward movement is stopped.

The spring bias forcing Suhler slider 54 forward therefore locates the device securely along the axis of the rifle's barrel. The interaction of Suhler slider 54 and mating notches 68 limits the vertical motion of rear ring 60. The interaction of mating surfaces 66 with corresponding surfaces in front Suhler base 46 limits the vertical motion of front ring 58. The lateral fit between the four descending lugs and the four slots in the Suhler bases limit any lateral motion. Thus, the telescopic sight is locked securely in place.

FIG. 4 illustrates the removal of the device, also using a cutaway through the bases. When the user wishes to remove old scope sight 56, he or she grabs Suhler slider 54 (using the attached tabs) and pulls it rearward. Suhler slider 54 then travels free of mating notches 68 in rear Suhler lugs 64. At this point, the user grasps the rear portion of old scope mount 56 and rotates it upward as shown. Once rear Suhler lugs 64 are clear, the user may pull front Suhler lugs 62 free of front Suhler base 46 as well. He entire assembly is then removed.

Installation of the device is basically the reverse of the process just described. The user starts by placing front Suhler lugs 62 in front Suhler base 46. The user then pulls back on Suhler slider 54 (using the tabs), which allows rear Suhler lugs 64 to drop into rear Suhler base 48. The user then releases the tabs, allowing the device to engage and lock. It should be noted that some rear Suhler lugs 64 incorporate a beveled lower surface which automatically moves Suhler slider 54 rearward when the rear of old scope mount 56 is pressed down firmly (thereby eliminating the need for the user to grasp the tabs to attach the scope). This variation is actually the one illustrated.

FIGS. 3 and 4 also serve to illustrate a significant limitation of the Suhler design. The forward portion of old scope sight 56 is labeled in FIG. 3 as scope bell 18. This term is now in common use because modern scope sights have an objective lens which is much larger in diameter than the central tube. Thus, the forward portion of the scope is bell-shaped—the diameter grows larger toward the forward end. This phenomenon is obviously not seen on old scope sight 56. Nevertheless, for purposes of consistency, the forward portion will be referred to as scope bell 18.

In FIG. 4, the reader will observe that the scope must be tilted forward to remove it from the prior art Suhler mounting system. This results in scope bell 18 very nearly contacting barrel 12 or rear sight 14. There is barely sufficient clearance for old scope sight 56 to be removed. Turning briefly to FIG. 8, the reader may observe modern scope sight 16. Scope bell 18 on modern scope sight 16 is both longer and larger than the one found on old scope sight 56. Returning now to FIGS. 3 and 4, those skilled in the art will readily appreciate that a modern scope sight cannot be used on the prior art device illustrated, since it cannot be removed due to the mechanical interference between scope bell 18 and the rifle.

The Suhler mount suffers from a second inherent drawback. Not only have modern scope sights grown larger, they are also considerably heavier than old scope sight 56. The inertial forces generated under rifle recoil are therefore more significant. The front interface between bases and lugs in the Suhler mount is a pure metal-to-metal contact. The rear interface, in contrast, depends on the spring loading of Suhler lug 54.

Returning now to FIG. 3, when the rifle is fired, rifle receiver 10 undergoes a sharp rearward impulse. This movement is imparted to front ring 58 as recoil impulse 106 (the geometry prohibits any significant transfer through rear ring 60). Because recoil impulse 106 is applied well below and in front of the center of gravity of old scope sight 56, it generates recoil torque 108. Recoil torque 108 tends to force old scope sight 56 to rotate in a counterclockwise direction (in the view as shown). This, in turn, tends to lift rear ring 60 out of rear Suhler base 48. Thus, substantial recoil tends to loosen the device.

Those skilled in the art will also realize that the mechanical interface between Suhler slider 54 and mating notch 68 must be fitted very carefully in order for the device to work. This fitting is typically done by hand, using the Prussian blue or "thickness of smoke" process of scraping away the high spots to produce a perfect fit. As the device wears over time, this mechanical fit often tends to become loose.

Accordingly, the prior art devices are limited in that they:

1. Require the operation of multiple latching mechanisms to apply or remove;
2. Do not allow the use of modern telescopic sights having large objective lenses and substantial weight;
3. Tend to loosen under recoil;
4. Do not incorporate wear compensating features; and
5. Require hand fitting of the interfacing components.

BRIEF SUMMARY OF THE INVENTION

The present invention comprises a detachable mount for a telescopic sight which can be operated using only one latching mechanism. The mount uses a front base attached to the ring of a rifle receiver and a rear base attached to the bridge of a rifle receiver. The upper surfaces of both the front and rear bases open into a pair of slots. A separate scope mount is attached to a scope sight by conventional means. Two sets of lugs descend from the lower surfaces of this scope mount. These sets of descending lugs are configured to fit securely within the slots in the front and rear bases when the scope mount is placed over the bases.

The forward facing surfaces of the rear set of descending lugs mate with a corresponding set of rearward facing surfaces in the slots within the rear base. These sets of mating surfaces are offset from the vertical to create a wedging effect that pulls the rear of the scope mount down when it is pushed forward relative to the rifle receiver.

The rearward facing surfaces of the front set of descending lugs open into tapered notches. The front base incorporates a transverse slider having a tapered surface which fits within the tapered notches in the front descending lugs. The interaction of this slider with the front lugs pushes the front of the scope mount forward while simultaneously pulling it down. The forward motion also serves to pull the rear of the scope mount down as described previously. Thus, the forward motion of this transverse slider tends to seat the scope mount firmly on the two bases.

When the user wishes to remove the device, the user pulls the transverse slider rearward and lifts the front of the scope mount up until the front lugs clear the front base. The user then pulls the rear lugs free from the rear base, thereby completely detaching the scope. Installation is the reverse of this procedure.

The geometry of the device employs the recoil impulse to actually promote engagement—rather than loosening it. The geometry also incorporates wear-compensating features. Finally, the geometry provides removal clearance for very large scope sights since the front of the scope is lifted for removal, rather than the back.

REFERENCE NUMERALS IN THE DRAWINGS

| | |
|---|---|
| 10 | rifle receiver |
| 12 | barrel |
| 14 | rear sight |
| 16 | modem scope sight |
| 18 | scope bell |
| 20 | scope eyepiece |
| 22 | receiver ring |
| 24 | receiver bridge |
| 26 | front base |
| 28 | rear base |
| 30 | loading/ejection port |
| 32 | slider |
| 34 | tab |
| 36 | tab slot |
| 38 | spring |
| 40 | plug |

-continued

| | |
|---|---|
| 42 | lower notch surface |
| 44 | front dovetail cut |
| 46 | front Suhler base |
| 48 | rear Suhler base |
| 50 | front Suhler slot |
| 52 | rear Suhler slot |
| 54 | Suhler slider |
| 56 | old scope sight |
| 58 | front ring |
| 60 | rear ring |
| 62 | front Suhler lug |
| 64 | rear Suhler lug |
| 66 | mating surface |
| 68 | Suhler mating notch |
| 70 | threaded hole |
| 72 | mounting hole |
| 74 | base screw |
| 76 | spring bore |
| 78 | lateral slot |
| 80 | front slot |
| 82 | rear slot |
| 84 | scope clamp |
| 86 | scope screw |
| 88 | scope mount |
| 90 | rear cradle |
| 92 | front cradle |
| 94 | threaded hole |
| 96 | front lug |
| 98 | rear lug |
| 100 | access hole |
| 102 | ejection relief |
| 104 | tapered notch |
| 106 | recoil impulse |
| 108 | recoil torque |
| 110 | tapered surface |
| 112 | lanyard |
| 114 | ball plunger |
| 116 | slider forward surface |
| 118 | lug rearward surface |

DETAILED DESCRIPTION OF THE INVENTION

Figure 5:
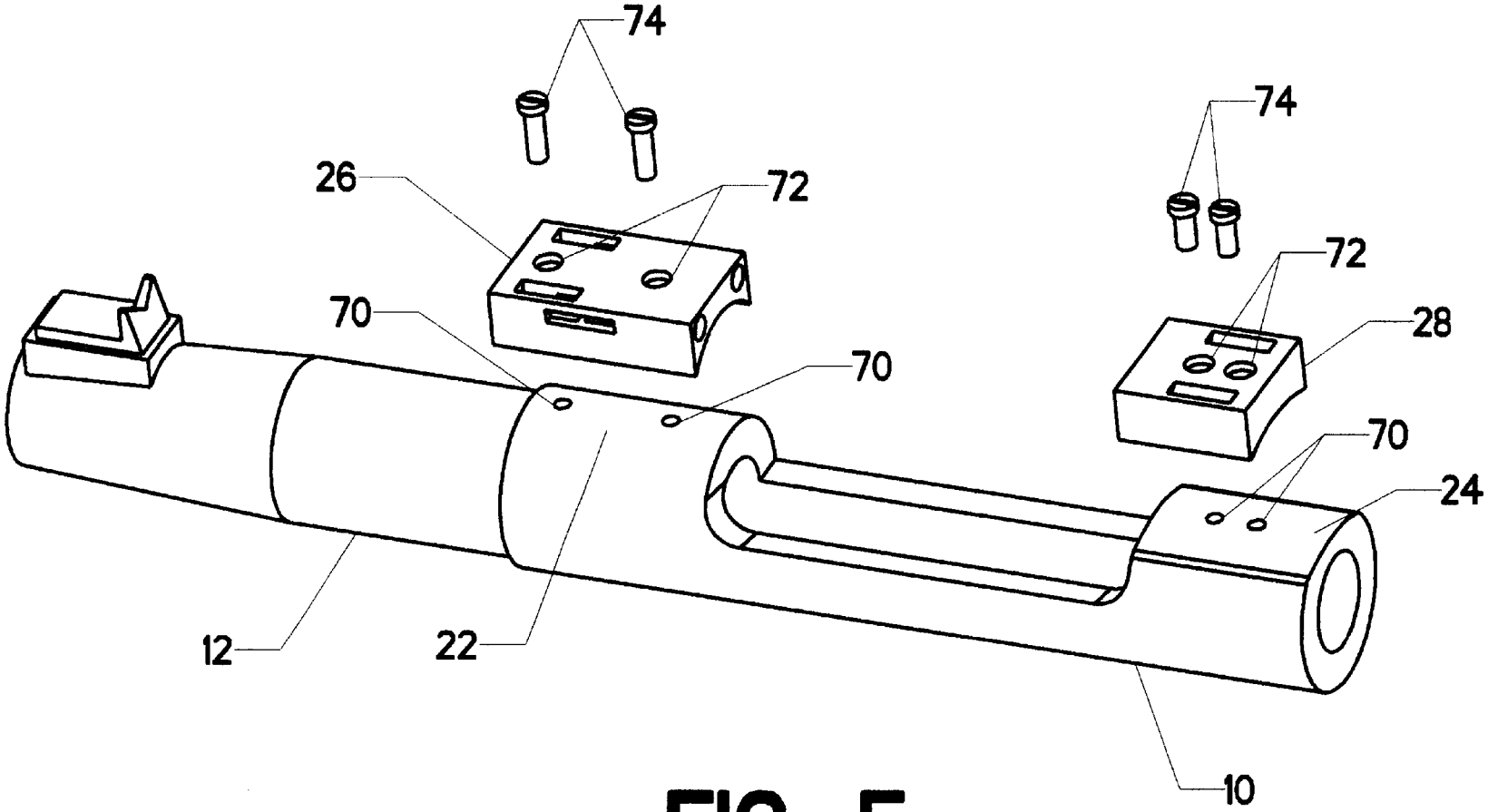
FIG. 5 is an isometric view, showing the bases used in the present invention.

FIG. 5 shows rifle receiver 10, which is similar in general configuration to the one illustrated with the prior art Suhler device. Barrel 12 is mated to the forward portion of rifle receiver 10, known as receiver ring 22. Rifle receiver 10 has a longitudinal axis which is concentric with the bore of barrel 12; i.e., it runs generally front to rear, with receiver ring 22 being located at the front of rifle receiver 10 and receiver bridge 24 being located at the rear of rifle receiver 10. Receiver ring 22 is separated from receiver bridge 24 by loading/ejection port 30. Rifle cartridges are loaded—and the spent shell casings are ejected—through loading ejection port 30. It is therefore important to keep this area clear of obstructions.

As shown in FIG. 5, rifle receiver 22 includes four threaded holes 70. These holes, which are intended to accommodate fixed scope sight mounts, are commonly found on modern rifles. For older rifles, they must often be added.

Front base 26 is designed to fit on top of receiver ring 22. The reader will observe that the underside of front base 26 is shaped to mate with the cylindrical surface of receiver ring 22. Two mounting holes 72 are provided in front base 26. A pair of base screws 74 are inserted into mounting holes 72 and threaded into threaded holes 70 in receiver ring 22. Base screws 74 are typically socket head cap screws. Mounting holes 72 are through-holes incorporating an upper counterbore to accommodate the socket heads of base screws 74. When base screws 74 are tightened, front base 26 is pulled tightly against receiver ring 22 and the upper extremes of base screws 74 lie just below the upper surface of front base 26.

Rear base 28 is designed to fit on top of receiver bridge 24. Rear base 28 also includes a pair of counterbored mounting holes 72. A second pair of base screws 74 are used to mount it in the same fashion as that described for front base 26.

Figure 6:
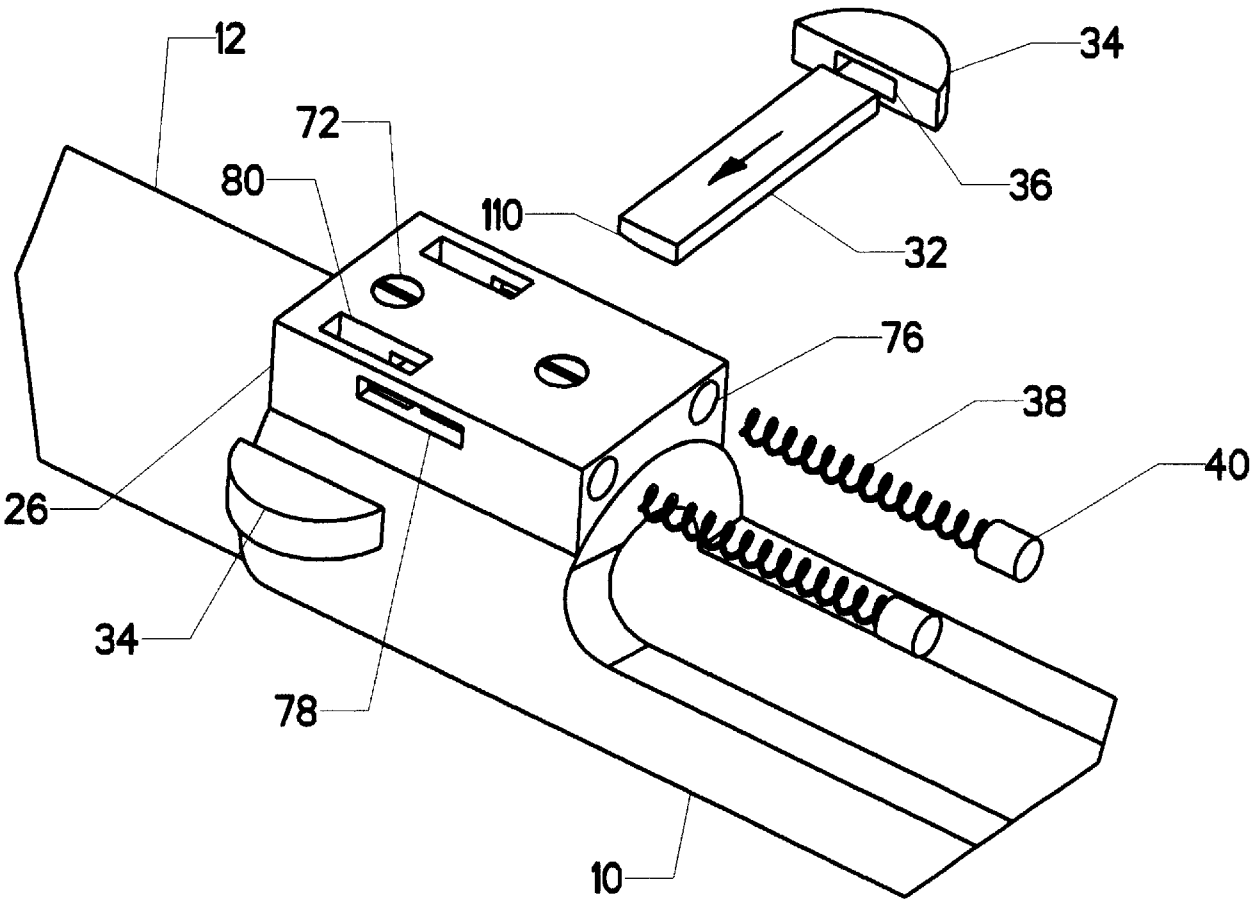
FIG. 6 is an isometric view, showing the front base.

FIG. 6 shows front base 26 in place on receiver ring 22. The upper surface of front base 26 opens into two front slots 80. These slots pass vertically though front base 26. The bounding walls of both front slots 80 are purely vertical. Lateral slot 78 passes through front base 26 in a direction which is parallel to the upper surface of front base 26 and transverse to the longitudinal axis of rifle receiver 10.

Slider 32 is placed within lateral slot 78, where it is free to translate forward (toward barrel 12) and rearward (toward receiver bridge 24). It is important for the user to be able to grasp and move slider 32. Thus, it is made long enough so that a portion sticks out each side of front base 26. In order to make slider 32 easier to grasp, a tab 34 is secured on each end. Each tab 34 is secured by placing its tab slot 36 over the exposed end of slider 32. It is then fixed in place using a screw, dowel, solder, or other conventional means. The outer surfaces of tab 34 may be textured in order to aid the user's grip. Tabs 34 serve the additional purpose of preventing slider 32 from sliding out one side or the other of front base 26.

It is important in the device's operation that slider 32 be biased forward. This bias could be accomplished using many prior art methods, but spring loading has been found particularly effective. Thus, spring bores 76 are provided in front base 26. They run from the rear surface of front base 26 forward to intersect internally with lateral slot 78. Springs 38 are placed within spring bores 76. They are held in position by a pair of plugs 40, which can be threaded or press fit into position. Those skilled in the art will realize that with these elements in place, slider 32 will be biased toward a forward position, with its forward surfaces coming to rest against the forward surfaces of lateral slot 78.

Figure 7:
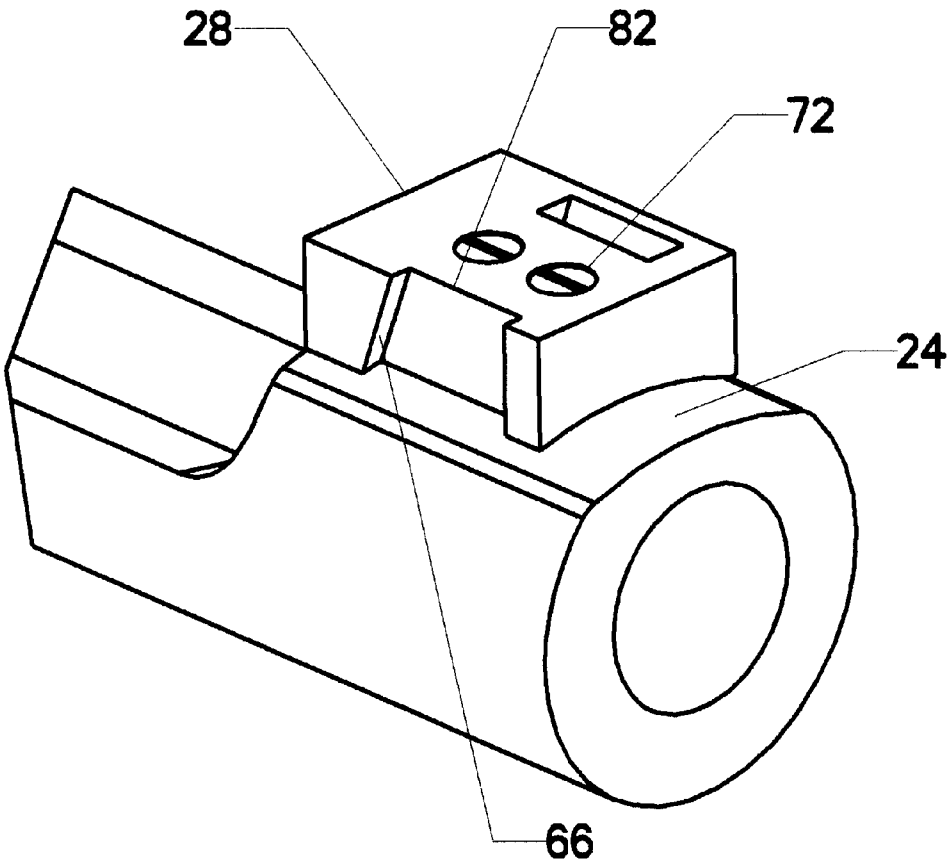
FIG. 7 is an isometric view with a cutaway, showing the rear base.

FIG. 7 illustrates rear base 28 in position on receiver bridge 24. The upper surface of rear base 28 opens into a pair of rear slots 82. A cutaway is included in this view to illustrate the internal nature of rear slots 82. Each rear slot 82 is bounded by four walls—a rearward facing one, a forward facing one, and two lateral ones. The rearward facing surface is significant in that it is inclined from the vertical. This surface is designated in the view as mating surface 66. The reader will observe that it is inclined sharply, with its upper extreme being further away from barrel 12 than its lower extreme.

Figure 8:
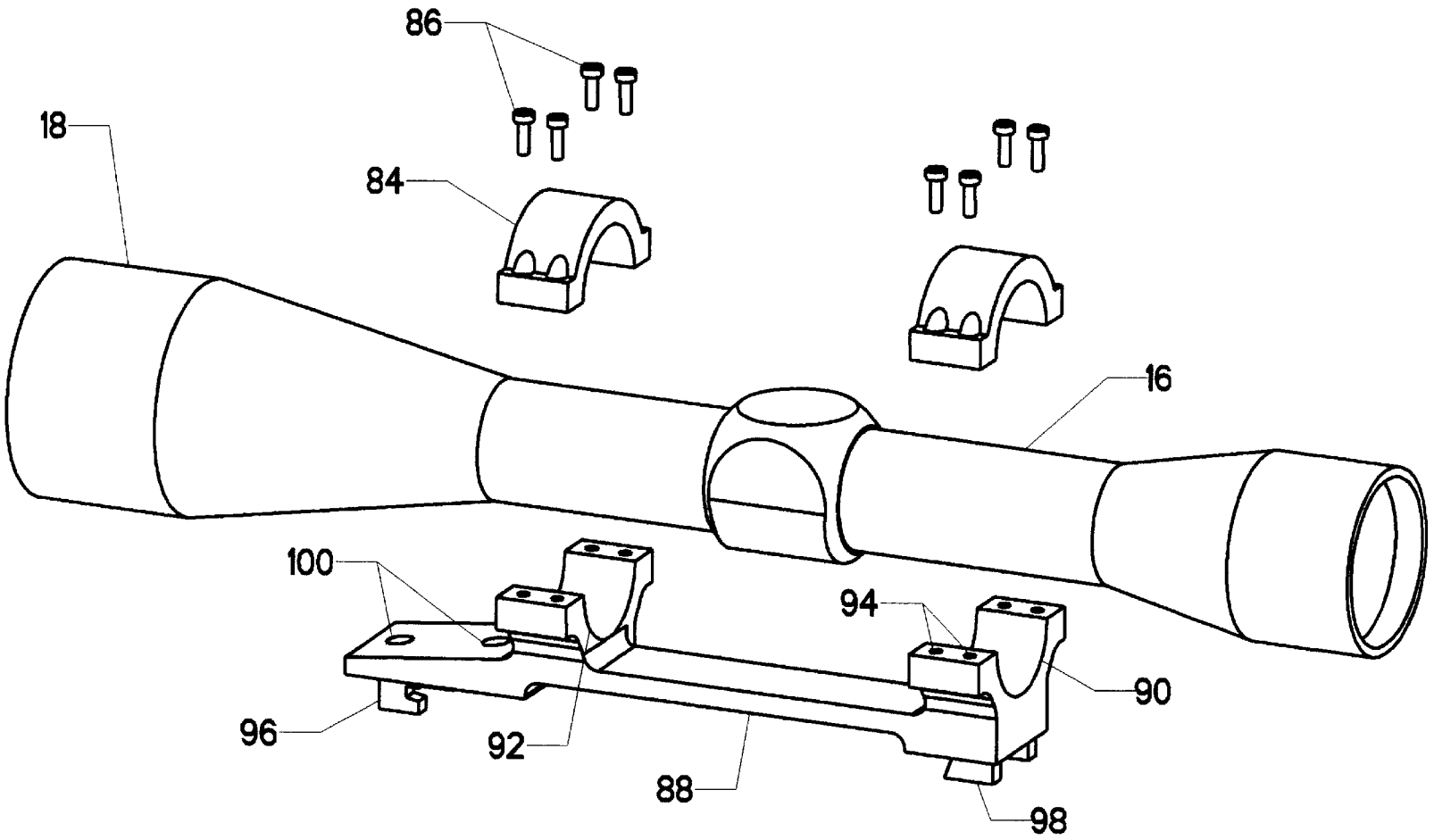
FIG. 8 is an isometric view, showing the attachment of a modern scope sight to the scope mount.

FIG. 8 illustrates the third major component of the invention—scope mount 88. Scope mount 88 includes rear cradle 90 and front cradle 92. Each of these cradles include four threaded holes 94 in their upper surfaces. Modern scope sight 16 fits within the two cradles. A pair of scope clamps 84 are placed over modern scope sight 16 and locked in placed by threading scope screws 86 through clearance holes provided in scope clamps 84 and into threaded holes 94. Thus, modern scope sight 16 is securely locked to scope mount 88.

Figure 9:
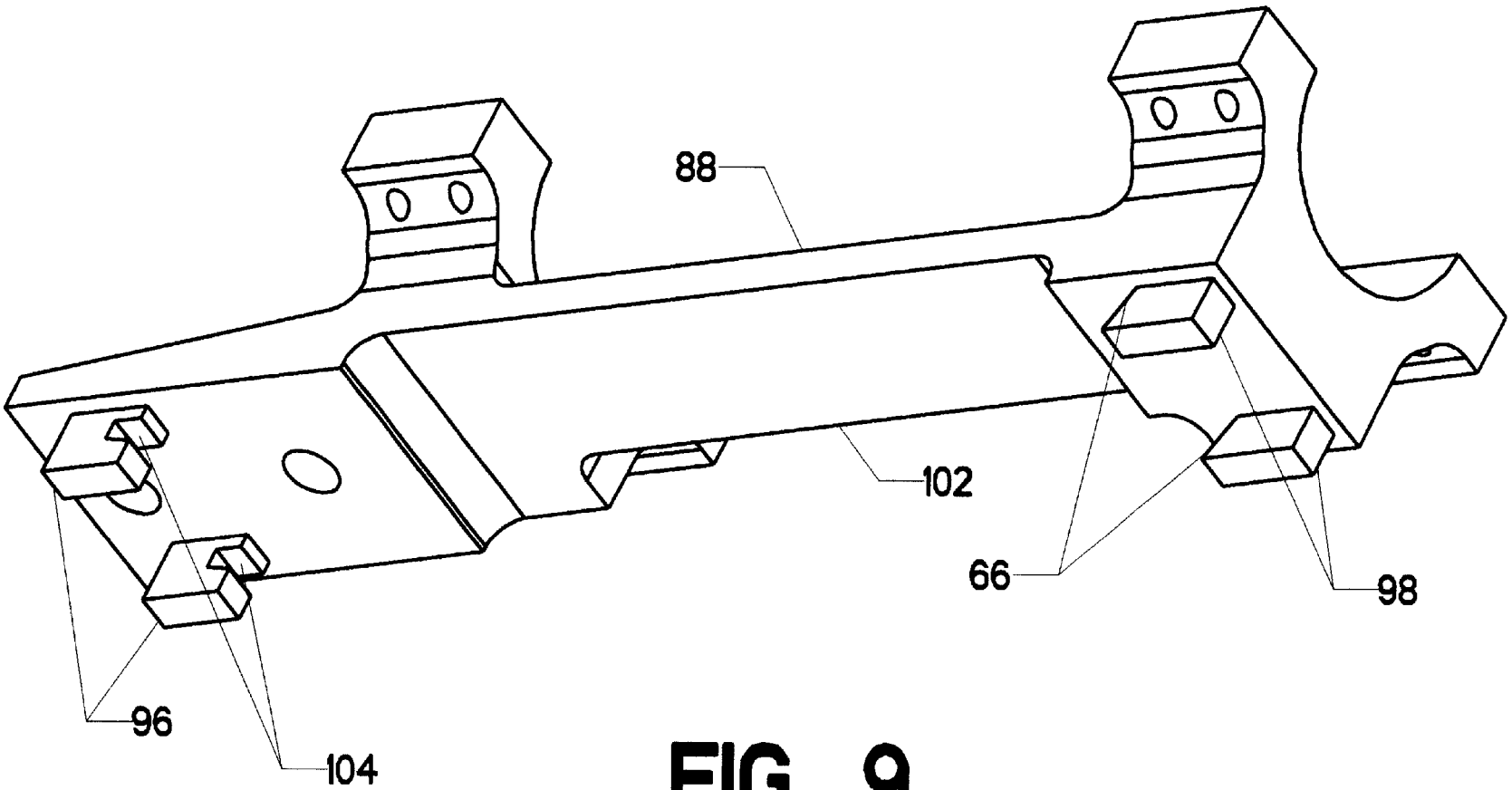
FIG. 9 is an isometric view, showing details of the scope mount.

A pair of front lugs 96 descend from the forward portion of scope mount 88. Likewise, a pair of rear lugs 98 descend from the rear portion of scope mount 88. FIG. 9 better illustrates these lugs. The reader will observe that front lugs 96 incorporate a transverse tapered notch 104 in their rearward facing surfaces. The reader will also observe that the forward facing surfaces of rear lugs 98 are inclined from the vertical, with their lower extremes being closer to the front lugs than their upper extremes. Ejection relief 102 is provided to allow clearance for loading and ejection over loading/ejection port 30. This relief can be provided on both sides, since rifles are now commonly made in right-handed and left-handed variants.

Front lugs 96 are designed to fit securely within front slots 80 in front base 26. The side walls produce a close sliding fit. The forward facing walls and rearward facing walls, however, have some clearance. Rear lugs 98 are designed to fit securely within rear slots 82 on rear base 28. The side walls again produce a close sliding fit. There is also clearance between the forward and rearward facing walls. The result of this clearance is that when scope mount 88 is placed on front base 26 and rear base 28 by inserting the respective lugs into the respective slots, it is still free to move forward and backward to some degree. It cannot, however, move laterally.

Comparing FIGS. 7 and 9, those skilled in the art will realize that mating surface 66 on scope mount 88 (which is inclined) will come into contact with mating surface 66 on rear mount 28 when scope mount 88 is moved forward with respect to the bases. Those skilled in the art will also realize that the interaction of these two inclined surfaces will produce a wedging effect.

Figure 10:
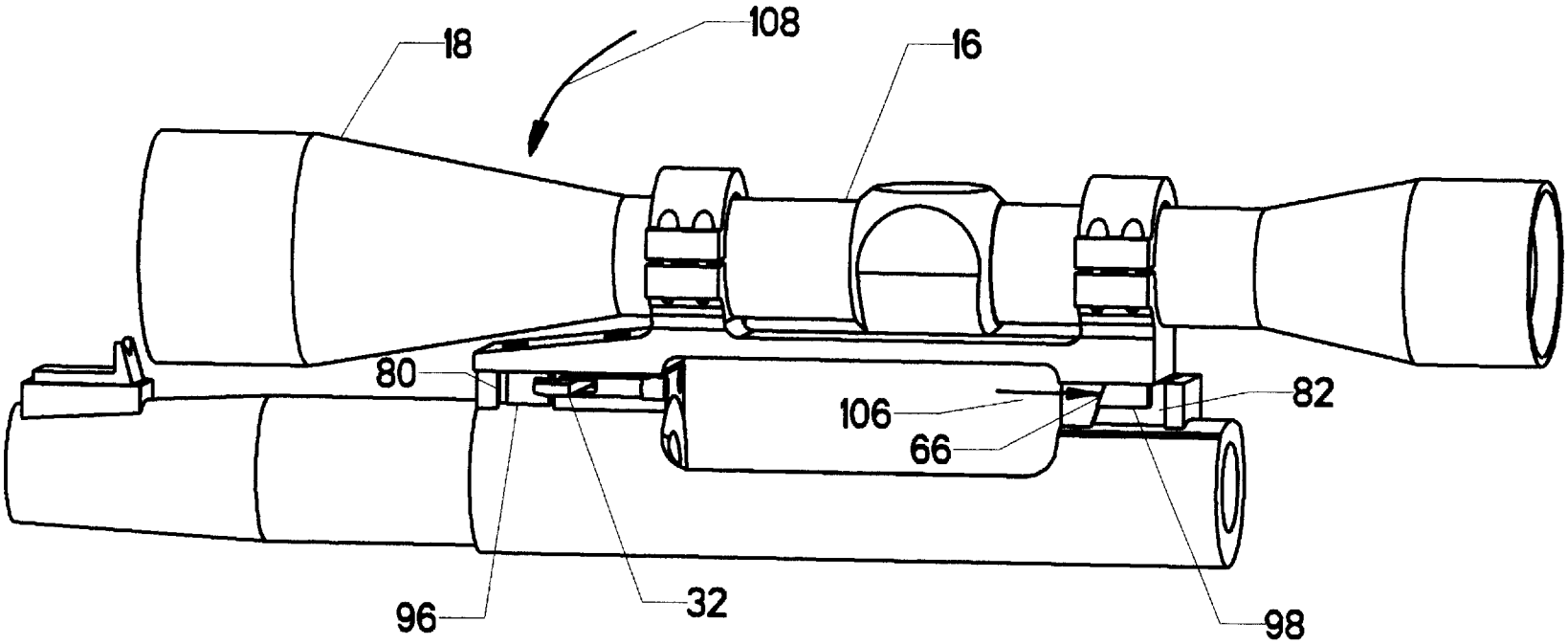
FIG. 10 is an isometric view with cutaways, showing the engagement of the mount.

FIG. 10—which incorporates cutaways in the two bases to show the internal features of the slots—illustrates this wedging phenomenon. The reader will observe that the nearest front lug 96 rests within the nearest front slot 80 with clearance in front and behind. This clearance allows scope mount 88 to move forward and backward with respect to front base 26. As mentioned previously, the close fit between the vertical side walls of the front slots and the vertical side walls of the front lugs prevents any lateral movement.

The nearest rear lug 98 also rests within the nearest rear slot 82. There is clearance behind rear lug 98, but in the position shown there is no clearance in front of rear lug 98. In the position shown, scope mount 88 has been pushed forward until mating surface 66 on rear lug 98 has come into contact with mating surface 66 on rear base 28. Those skilled in the art will readily appreciate that the interaction of these mating surfaces produces two results: (1) rear lug 98 is pulled down until the rear of scope mount 88 rests firmly against the upper surface of rear base 28; and (2) all further forward progress of scope mount 88 relative to the two bases is stopped. The rear of scope mount 88 is thereby firmly seated with respect to rear base 28.

Figure 10B:
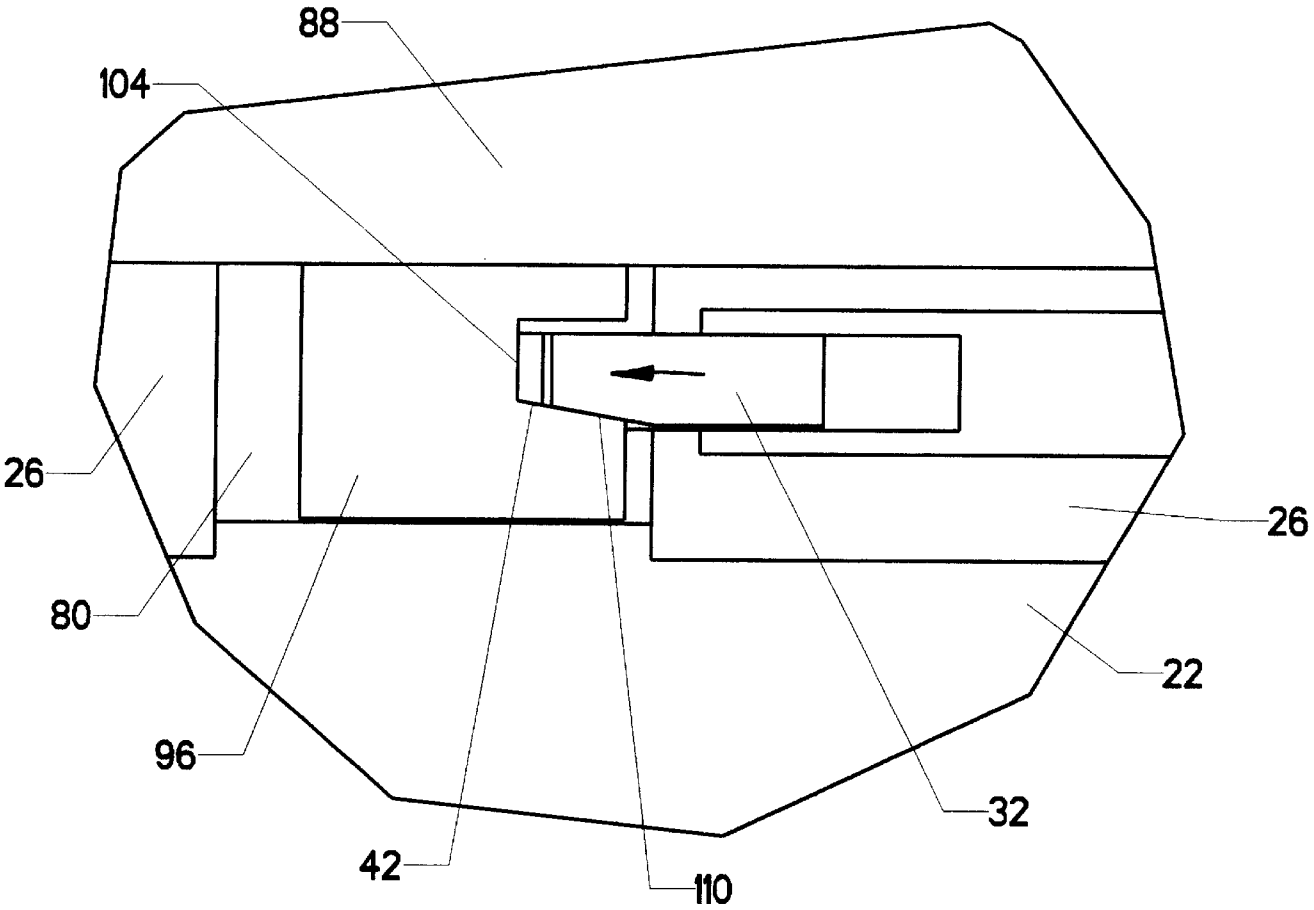
FIG. 10B is a detail view, showing the engagement of the slider in the tapered notch.

Scope mount 88 is pushed forward by the interaction of slider 32 with tapered notch 104 in front lug 96. The reader will recall that slider 32 is biased forward by springs. FIG. 10B illustrates the nature of slider 32 and tapered notch 104 in greater detail. The reader will observe that the forward portion of slider 32 encompasses tapered surface 110. Tapered notch 104 encompasses a correspondingly tapered lower notch surface 42. The interaction of these two surfaces produces a second wedging effect. As slider 32 pushes forward, it produces two results: (1) front lug 96 is pulled down until the front of scope mount 88 rests firmly against the upper surface of front base 26; and (2) scope mount 88 is forced forward. The fact that scope mount 88 is forced forward produces the seating of rear lug 98 described previously. Thus, the motion of slider 32 creates the mechanical lock-up in both bases.

It is important to understand how recoil is transmitted within the device. Returning now to FIG. 10, those skilled in the art will understand that recoil impulse 106 will be transmitted through mating surfaces 66 in rear base 28. Because this point is well to the rear of the center of gravity of scope mount 88 and modern scope sight 16, counter-clockwise recoil torque 108 will be produced. Owing to the geometry of the device, recoil torque 108 actually tends to promote the firm seating of front lugs 96 within front base 26. The wedging effect of mating surfaces 66 also tends to promote the firm seating of rear lugs 98 within rear base 28.

The recoil phenomenon produces another effect which should be explained. Recoil actually produces two impulses: First, there is a sharp impulse to the rear. Second, there is a milder forward impulse as the rifle's rearward motion is checked by the user's shoulder. In looking at FIG. 10, those skilled in the art will realize that if the user grasps modern scope sight 16 and pulls it firmly toward the rear, it will move rearward through the compression of the springs holding slider 32 in position. If the user then releases modern scope sight 16 (or manually pushes it back forward), modern scope sight 16 and scope mount 88 will be pushed back forward by the springs and the device will re-seat itself as explained previously. This action of pulling back and releasing or pushing forward is actually very effective in returning scope mount 88 to exactly the same seated position with respect to the two bases (which is, of course, the key to maintaining the accuracy of the sighting device).

Those skilled in the art will realize that the double-impulse recoil phenomenon produces the same result. The first impulse accelerates the two bases and scope mount 88 rearward. The two bases then experience a deceleration (since they are mechanically locked to the rifle) when the user's shoulder decelerates the rifle. Scope mount 88 (with the other components attached) will travel further rearward, with the energy being expended to compress the springs biasing slider 32 into its forward position (springs 38). Springs 38 will eventually arrest scope mount 88's rearward travel with respect to the two bases. They will then propel it back forward—firmly reseating the device. Thus, by carefully selecting the stiffness of springs 38, the device actually uses the recoil to its advantage. The recoil is used to re-seat—and therefore re-zero the device—every time the rifle is fired.

If modern scope sight 16 has received a sharp blow in the field—causing the user to. suspect that the zero of the device may have shifted—the user can simulate the above-described recoil effect by pulling modern scope sight 16 rearward and allowing the device to snap back into the seated position (optionally including the step of assisting the springs by manually pushing the device forward). This is actually a recommended procedure.

It is significant to observe that slider 32 contacts tapered notch 104 on only one surface. FIG. 10B shows this fact. All the components of the invention are typically made of steel. However, as it is commercially advantageous to produce the parts via investment casting, the steel employed is not particularly hard. Some wear between the mating surfaces must therefore be expected. Those skilled in the art will realize that the design of slider 32 and tapered notch 104 allows for substantial wear compensation. As these surfaces wear, slider 32 will simply advance further and further into tapered notch 104. The same is true for mating surfaces 66 on rear lug 98 and rear base 28. As these wear, scope mount 88 will move slightly forward with respect to the two bases. The geometry of the device allows for this relative motion without weakening the mechanical lock-up.

Figure 1:
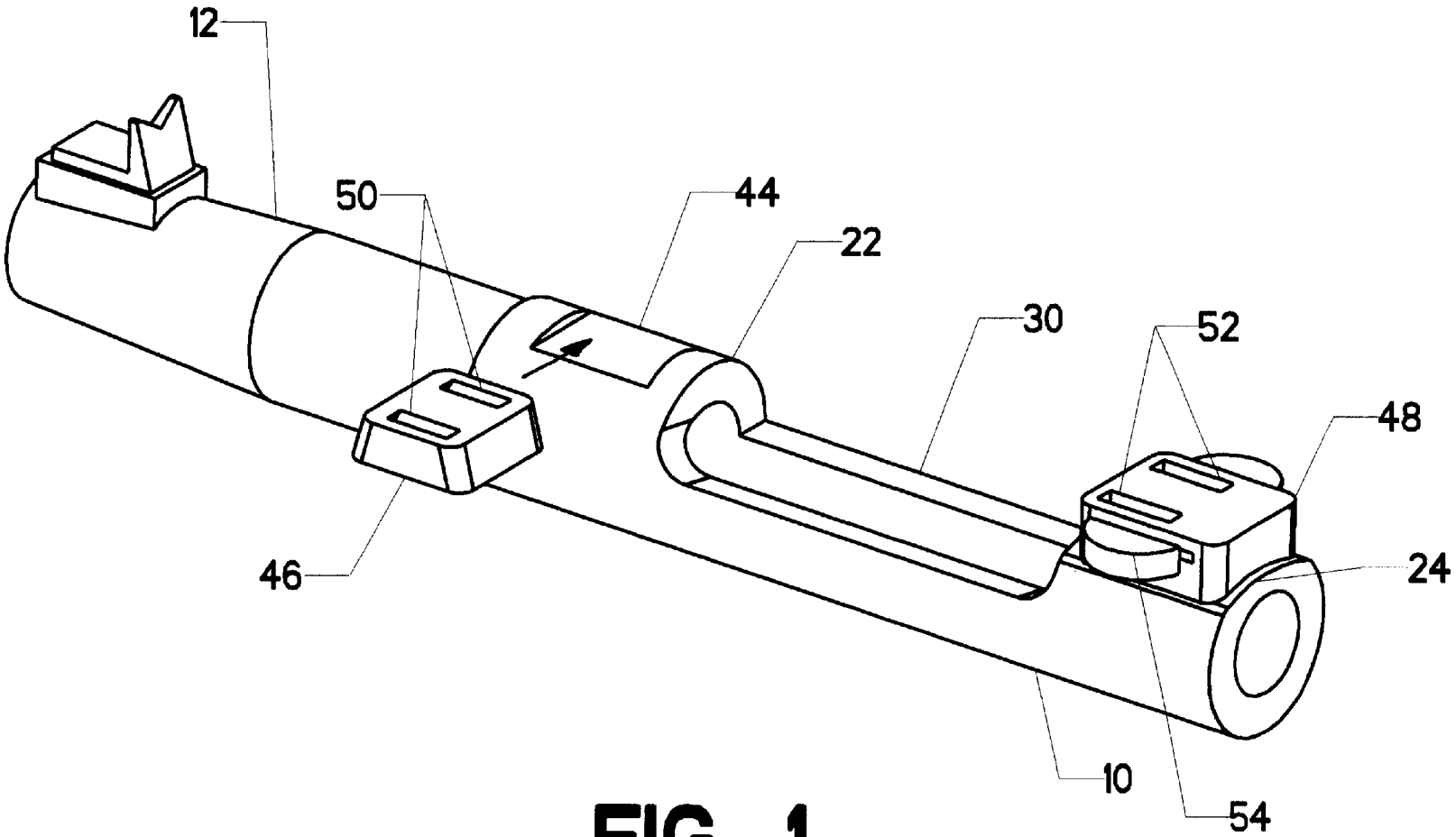
FIG. 1 (PRIOR ART)
FIG. 1 is an isometric view, showing the bases used in the prior art Suhler mount.
Figure 2:
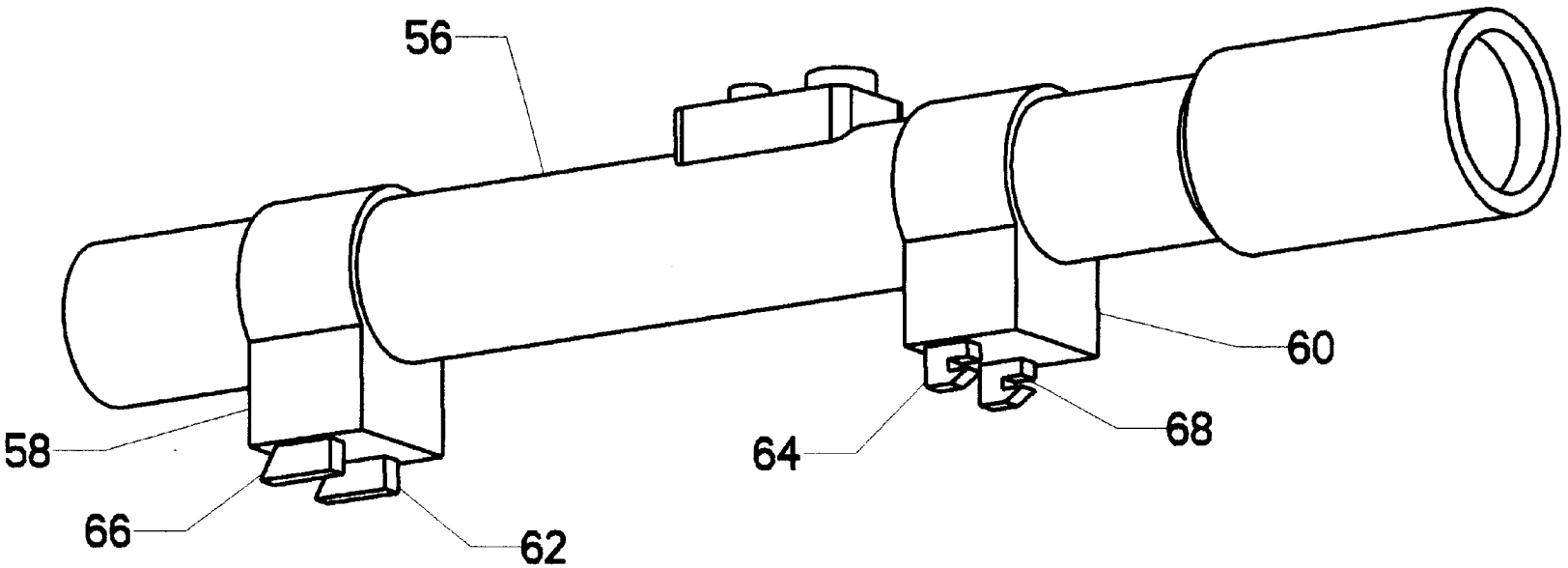
FIG. 2 (PRIOR ART)
FIG. 2 is an isometric view, showing the scope rings used in the Suhler mount.
Figure 3:
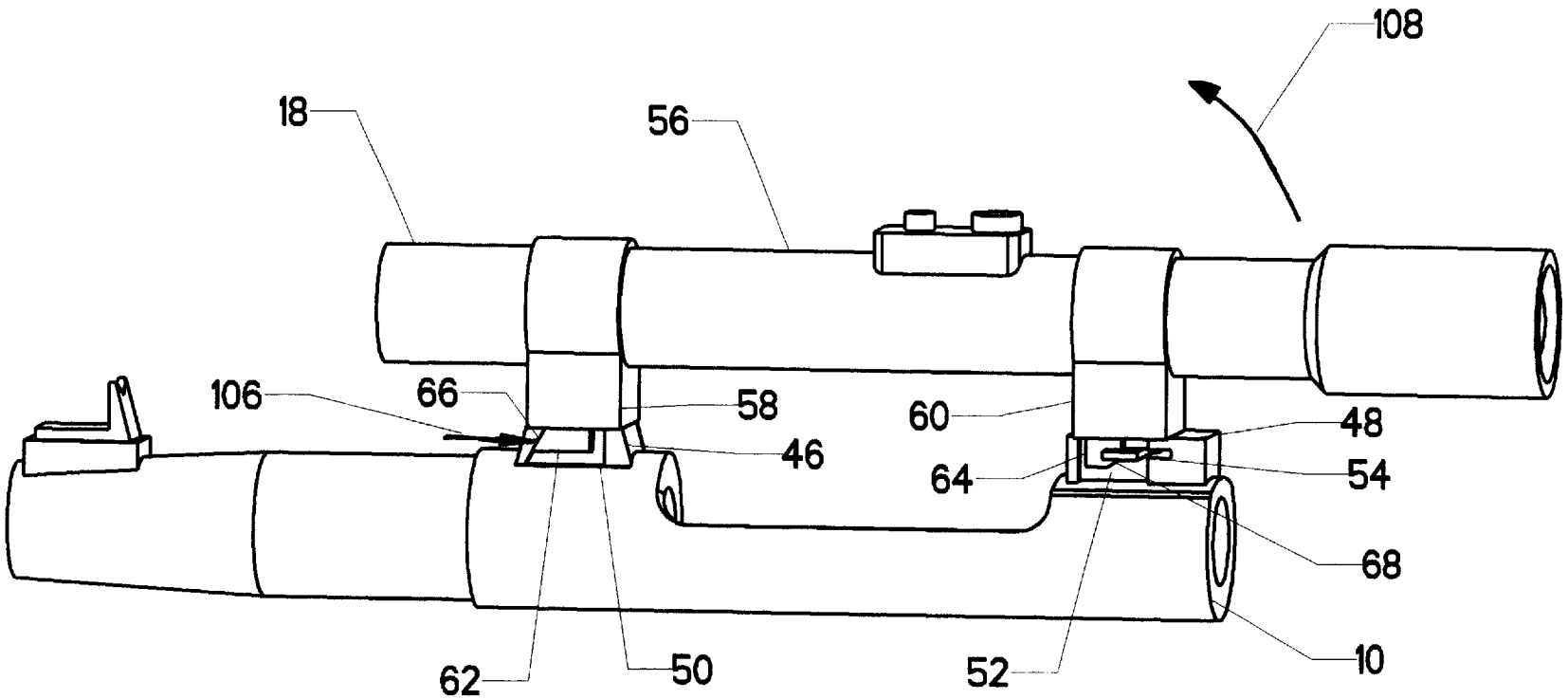
FIG. 3 (PRIOR ART)
FIG. 3 is an isometric view with cutaways, showing the engagement of the Suhler mount.
Figure 4:
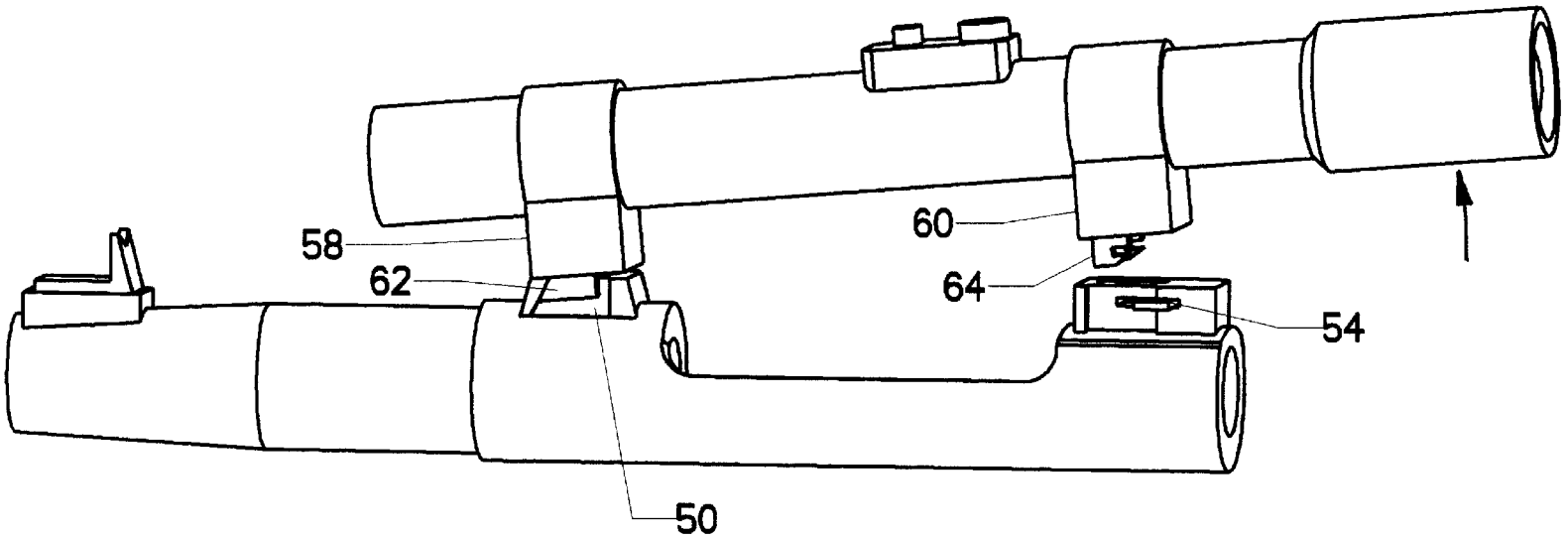
FIG. 4 (PRIOR ART)
FIG. 4 is an isometric view with cutaways, showing the removal of the Suhler mount.
Figure 11:
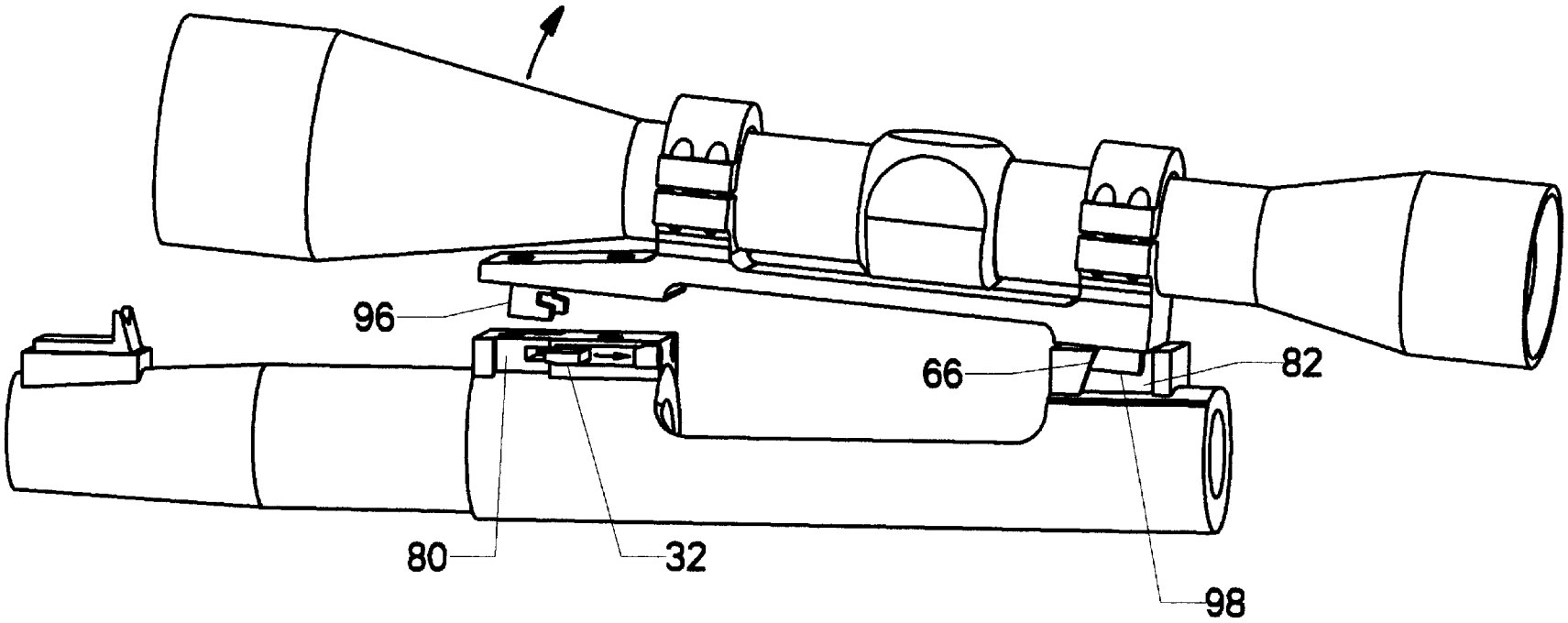
FIG. 11 is an isometric view with cutaways, showing the removal of the mount.

FIG. 11 illustrates the removal of the device (incorporating the same cutaways). In this view, the user has pulled slider 32 rearward, so that it is completely free of tapered notch 104. The user then pulls up on scope mount 88 so that front lug 96 rotates clear of front slot 80. Slider 32 is then release and rear lug 98 is pulled free of rear slot 82. The reader will readily appreciate that scope bell 18 has plenty of clearance with respect to rear sight 14 and barrel 12 during this procedure. Returning briefly to FIG. 4, the reader will also appreciate that if modern scope 16 is applied to the prior art Suhler mount (incorporating scope bell 18), it will be impossible to remove the device as scope bell 18 will hit rear sight 14 or barrel 12 before rear Suhler lug 64 can clear.

Installation of the present device is the reverse of the procedure just described. Returning to FIG. 11, the user first places rear lugs 98 in rear slots 82 (with the forward portion of modern scope sight 16 inclined upward to keep front lugs 96 above front slots 80). The user then pulls back on slider 32 and rotates front lugs 96 down into place. The user then releases slider 32 and allows it to snap forward. A recommended additional step—as discussed previously—is to then pull modern scope sight 16 rearward and allow the device to slide forward and firmly seat.

Figure 12:
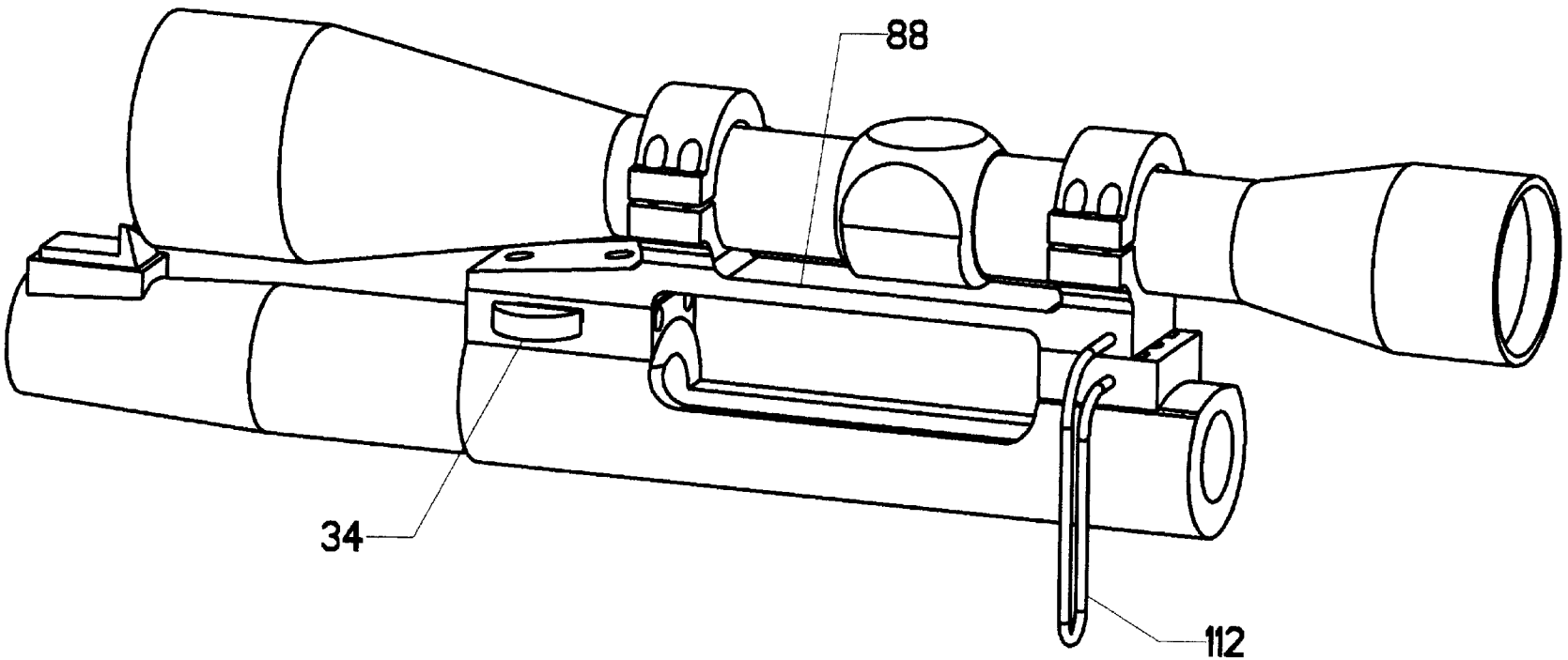
FIG. 12 is an isometric view, showing the mount in its installed position.
Figure 13:
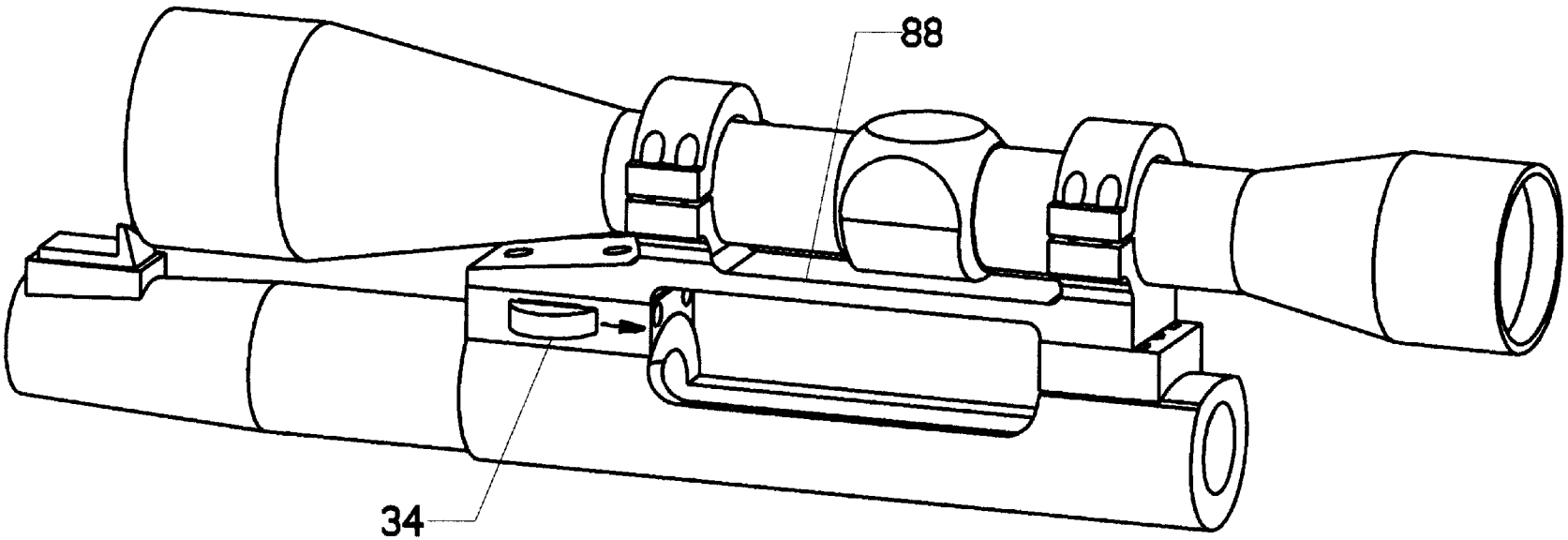
FIG. 13 is an isometric view, showing how the user pulls the slider out of the engaged position.
Figure 14:
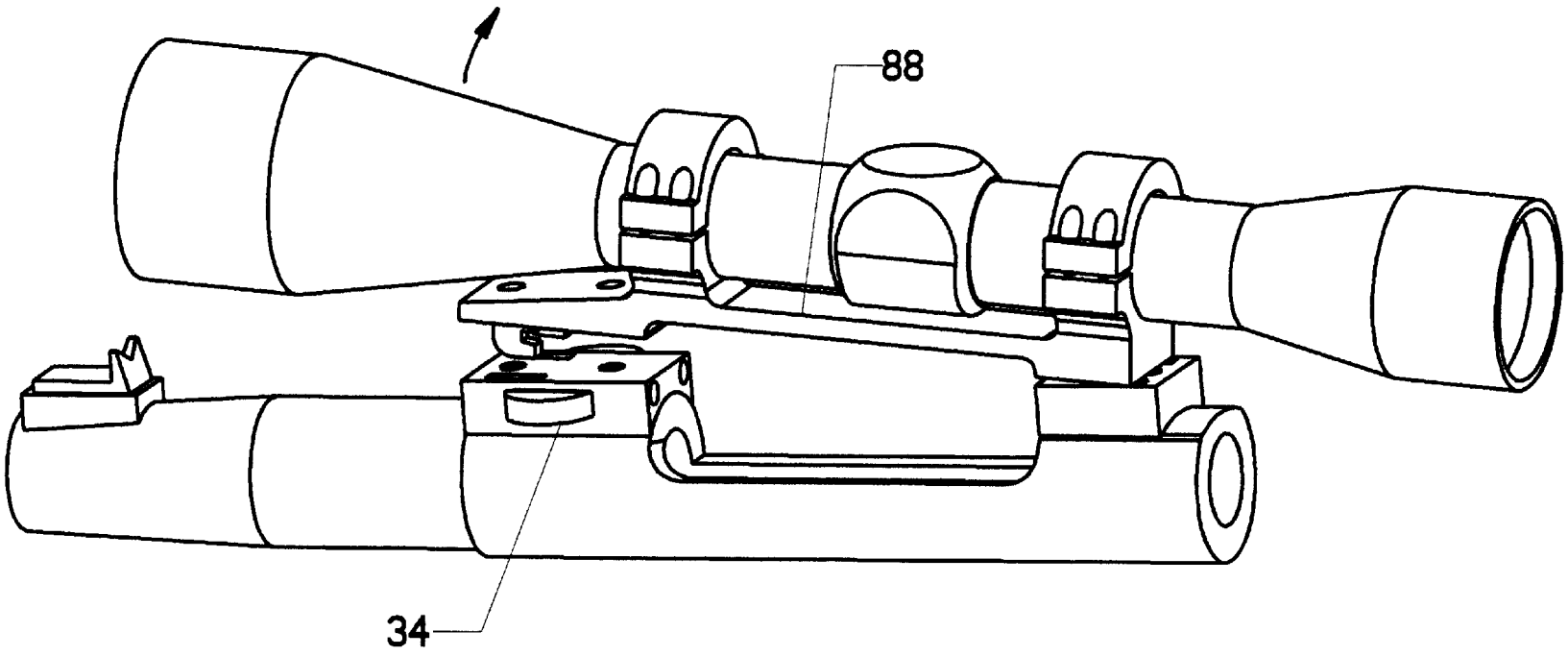
FIG. 14 is an isometric view, showing how the user rotates the front portion of the scope sight to remove it.
Figure 15:
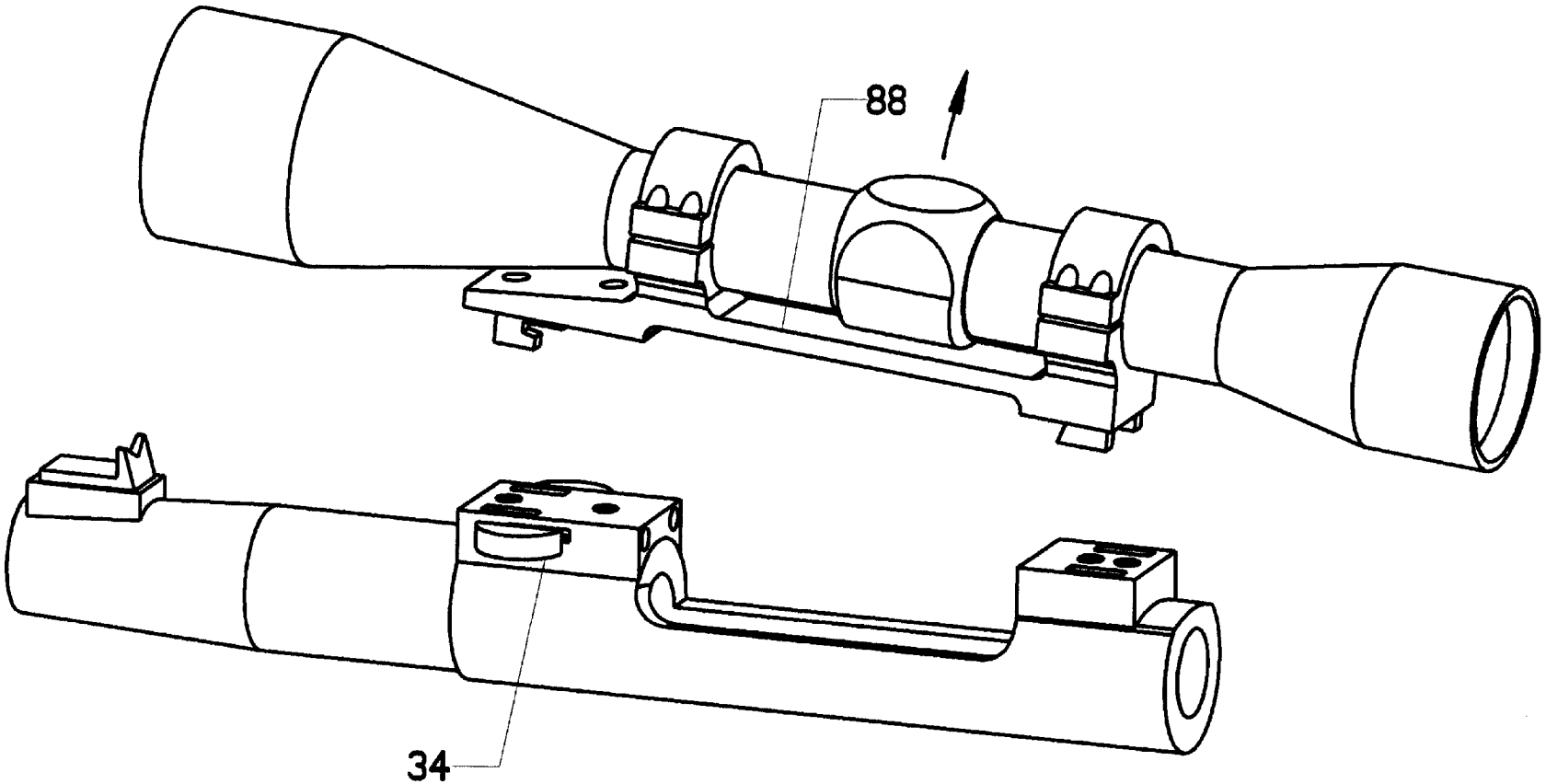
FIG. 15 is an isometric view showing how the user completes the removal process.

FIGS. 12 through 15 illustrate the removal process as it would actually be experienced by the user. In FIG. 12, the device is resting in its attached state. In FIG. 13, the user pulls rearward on the two tabs 34. The reader will recall that these are connected to slider 32. Thus, slider 32 is pulled rearward to the disengaged position. In FIG. 14, the forward portion of scope mount 88 is rotated free. In FIG. 15, the rearward portion of scope mount 88 is lifted free.

Installation is again the reverse. The user would start with the position shown in FIG. 15. The user would place rear lugs 98 within rear slots 82 as shown in FIG. 14. The user would then pull tabs 34 to the rear and rotate the forward portion of scope mount 88 down into position. Tabs 34 would then be released.

FIG. 12 also serves to disclose another element of the invention—lanyard 112. One of the primary advantages of the invention is the fact that it can be removed very quickly. A skilled operator can completely detach scope mount 88 in less than three seconds. Testing has revealed that it takes much more time to stow the removed telescopic sight than to remove it. In a situation involving wounded dangerous game, this loss of time could be crucial. Accordingly, lanyard 112 can be optionally installed between scope mount 88 and rear base 28 (or in any other convenient position—so long as it links scope mount 88 to the rifle in some fashion). With this embodiment installed, the user can simply drop the removed telescopic sight and allow it to dangle by lanyard 112. The user will obviously want to detach lanyard 112 and safely stow the telescopic sight once time permits. Thus, lanyard 112 is designed to detach when no longer needed.

It is helpful to understand some details of how the device is initially installed on a rifle. Returning to FIG. 5, front base 26 and rear base 28 are placed on rifle receiver 10 and base screws 74 are threaded into threaded holes 70, but not tightened. Both bases are therefore free to wobble a bit. The key is that when they are tightened, the slots must be aligned in order for the device to work.

While the bases are still loose, scope mount 88 (without modern scope sight 16) is put in place, with its lugs seated within the slots in the bases. This action ensures the alignment of the slots. While the user holds rear base 28 in place, scope mount 88 is then removed. While rear base 28 is still held, its two base screws 74 are tightened. This will likely cause rear base 28 to shift slightly. The user then reinstalls scope mount 88, wiggling front mount 26 so that all lugs firmly seat.

The reader will observe in FIG. 8 that access holes 100 are provided in the forward portion of scope mount 88. These are through-holes which align with mounting holes 72 in front base 26. With scope mount 88 in position, the user is therefore able to insert a tool through access holes 100 and tighten base screws 74 securing front base 26. Alignment of the slots in the two bases is thereby ensured. The reader should appreciate that additional access holes 100 could be provided in the rear of scope mount 88 so that this process could be carried out in a single step.

Those skilled in the art will appreciate that the alignment issue could be eliminated by making front base 26 and rear base 28 as a single integral piece. This option would increase the cost of the device, however. It also tends to disfigure the relatively clean appearance of the rifle when the scope sight is removed.

It is also possible to make scope mount 88 as two separate pieces—one incorporating front lugs 96 and front cradle 92, and one incorporating rear lugs 98 and rear cradle 90. This approach effectively uses the tube structure of modern scope sight 16 as a structural element. It therefore places considerable stress on modern scope sight 16, which is generally undesirable. It also makes the device more difficult to align and install. Accordingly, the embodiment illustrated in FIGS. 5 through 15, employing the one piece scope mount, is preferable.

During experimentation, the inventor has discovered that some users occasionally experience difficulty in executing the removal process illustrated in FIGS. 12 through 15. This difficulty centers on the stage shown in FIG. 14. Some users—especially those with smaller hands—find it difficult to pull the tabs rearward while also lifting up on the front of the telescopic sight. A modification was made to the invention to address this concern. As this modification assists all users—even those finding no difficulty previously—it is deemed the preferred embodiment.

Figure 16:
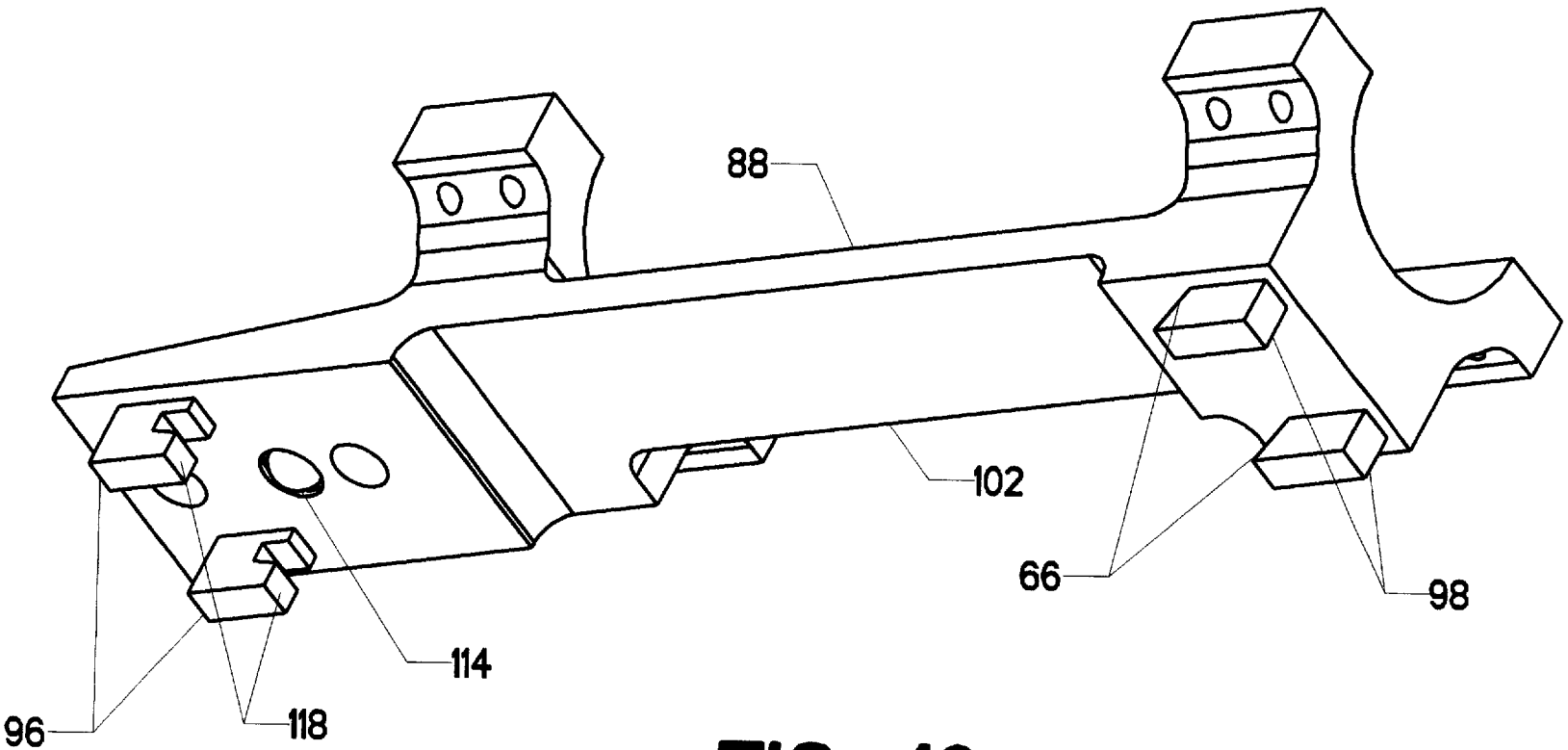
FIG. 16 is an isometric view, showing the addition of a ball plunger to the underside of the scope mount.

FIG. 16 illustrates again scope mount 88. The reader will observe, however, that in this preferred embodiment ball plunger 114 has been added to the underside of scope mount 88. Ball plunger 114 is a conventional piece of prior art hardware. It contains an encapsulated ball bearing which is spring loaded. The spring sits on top of the ball bearing and forces it downward against a stop collar which ultimately limits its downward motion. In its unloaded state, the ball bearing protrudes approximately 0.060 inches downward from the underside of scope mount 88. It can be depressed so that its lowermost extremity is flush with the surface of the underside of scope mount 88. This action compresses the spring.

When scope mount 88 in installed on the two bases, the ball bearing in ball plunger 114 is pushed into ball plunger 114 so that its lowermost extremity is flush with the surface of the underside of scope mount 88. At this point, the ball bearing is actually resting on the upper surface of front base 26. The reader will recall that scope mount 88 is designed to move fore and aft with respect to the bases when the rifle is fired. The bearing within ball plunger 114 is free to roll, thereby minimizing friction when scope mount 88 moves fore and aft with respect to the two bases.

Figure 17:
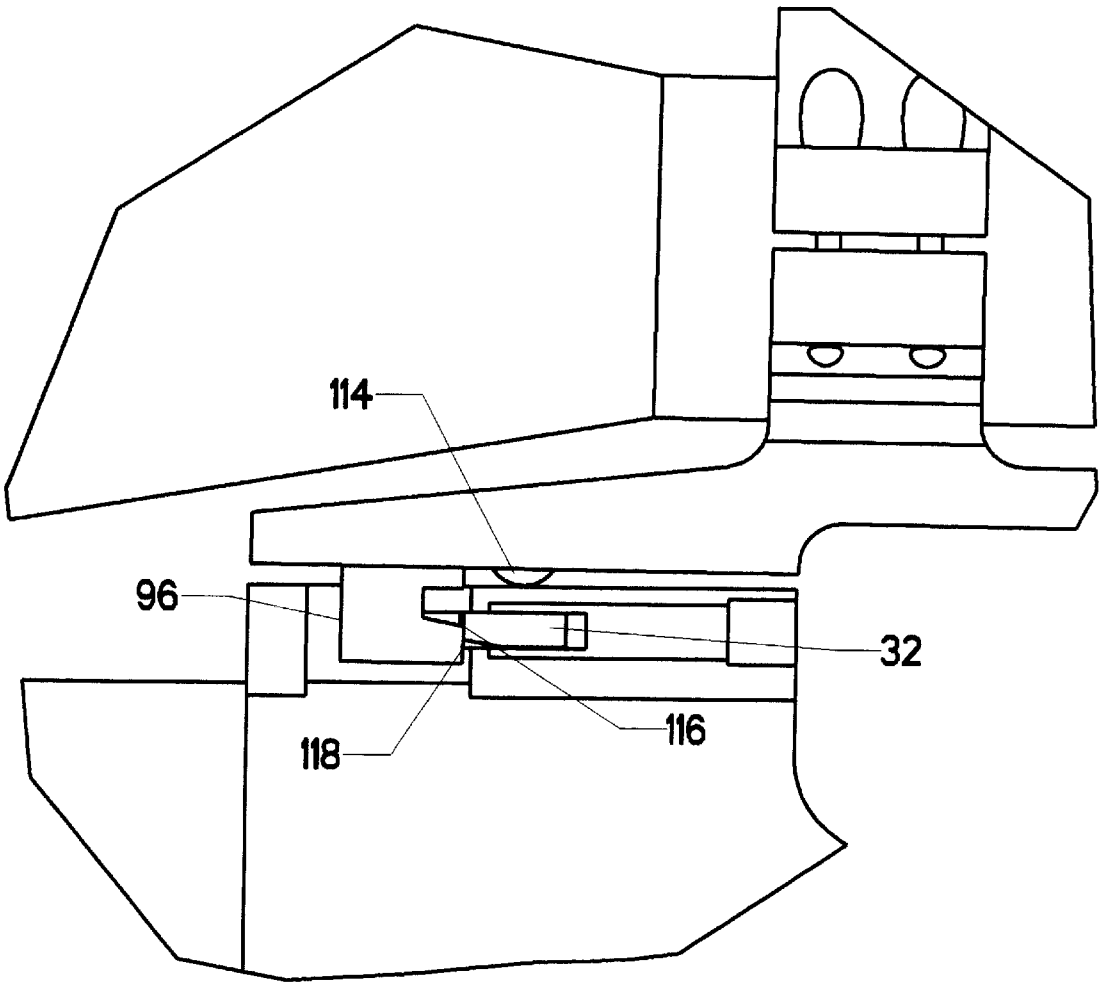
FIG. 17 is an elevation view with cutaways, demonstrating the affect of the ball plunger.

Those skilled in the art will realize that once slider 32 is disengaged from front lugs 96, the compressed spring within ball plunger 114 will lift the front portion of scope mount 88. FIG. 17 illustrates this action. The reader will observe that slider 32 has been pulled clear of the notch within front lug 96. The spring within ball plunger 114 has then raised the forward portion of scope mount 88, resulting in the ball bearing again protruding beyond the lower surface of scope mount 88.

At this point, the user has two options. If the user simultaneously pulls up on the forward portion of the scope or scope mount 88, then scope mount 88 can be removed in one continuous motion. If the user prefers, however, the user can simply release slider 32 and allow it to slide back forward. If this option is taken, springs 38 (which tend to bias slider 32 forward) will push slider forward surface 116 tightly against lug rearward surface 118. This frictional engagement will hold scope mount 88 in the elevation position shown. However, the user need only grasp the front of the scope or scope mount 88 and lift it free. It is easy for the user to overcome the purely frictional engagement between slider forward surface 116 and lug rearward surface 118.

Thus, the second option allows the user to remove scope mount 88 as follows: (1) The user grasps tabs 34 and pulls them back to the rearward extreme of travel (which action carries slider 32 to its rearward extreme and allows the forward portion of scope mount 88 to pop up); (2) The user releases tabs 34 (which causes scope mount 88 to be frictionally secured in its popped up position); and (3) The user, at his or her convenience, then grasps the forward portion of the scope or scope mount 88 and pulls it free.

Although a ball plunger has been illustrated, those skilled in the art will realize that many types of mechanisms could be employed to cause the front portion of scope mount 88 to pop up when slider 32 is pulled rearward. As one example, camming surfaces could be incorporated in the rearward portions of slider 32. These camming surfaces could act against additional lugs descending from scope mount 88, so that as slider 32 is pulled rearward these camming surfaces would engage the additional lugs on scope mount 88 causing the forward portion of scope mount 88 to move upward.

Having read the preceding descriptions, the reader will understand that the preferred embodiment:

1. Requires the operation of only a single latching mechanism to apply or remove;
2. Allows the use of modern telescopic sights having large objective lenses and substantial weight;
3. Tends to re-seat itself under recoil;
4. Incorporates wear compensating features; and
5. Does not require hand fitting of the interfacing components.

Although the preceding description contains significant detail, it should not be construed as limiting the scope of the invention but rather as providing illustrations of the preferred embodiment of the invention. Thus, the scope of the invention should be fixed by the following claims, rather than by the examples given.

Having described my invention, I claim:

1. A detachable mount for removably attaching a scope sight to a rifle, wherein said rifle includes a barrel and a receiver, and wherein said receiver has a longitudinal axis approximately aligned with said barrel, and wherein said receiver has a receiver ring in a front position proximate said barrel and a receiver bridge in a rear position distal to said barrel, comprising:

a. a front base, having an upper surface, attached atop said receiver ring by any conventional means, wherein said upper surface opens into a front slot, and wherein said front base opens into a lateral slot oriented in a direction approximately parallel to said upper surface and approximately transverse to said longitudinal axis of said rifle receiver;

b. a rear base, having an upper surface, attached atop said receiver bridge by any conventional means, wherein said upper surface opens into a rear slot, wherein said rear slot is bounded by a rearward facing wall and two lateral walls, with each of said walls having an upper and lower extreme, and wherein said rearward facing wall is inclined so that said upper extreme of said rearward facing wall is further from said rifle barrel than said lower extreme of said rearward facing wall;

c. a slider, slidably mounted within said lateral slot in said front base;

d. a scope mount, fixedly attached to said scope sight by any conventional means, and having a front lug and a rear lug descending therefrom;

e. wherein said front lug is sized to slidably fit within said front slot and said rear lug is sized to slidably fit within said rear slot;

f. wherein said rear lug has a forward facing surface having an upper extreme and a lower extreme, and wherein said forward facing surface is inclined so that said lower extreme is closer to said front lug than said upper extreme;

g. wherein said front lug has a rearward facing surface which opens into a notch sized to accommodate said slider, so that when said front and rear lugs are placed within said front and rear slots, and when said slider is moved forward toward said barrel, said slider engages said notch, thereby locking said front lug within said front base, and said slider pushes said scope mount forward toward said barrel, thereby pushing said forward facing surface on said rear lug against said rearward facing surface on said rear slot, thereby locking said rear lug within said rear base; and h. biasing means for biasing said slider forward toward said barrel.

2. A detachable mount as recited in claim 1, wherein said front base further comprises a right side surface and a left side surface, and wherein said slider is longer than said transverse slot so that a portion of said slider protrudes beyond said right side surface and a portion of said slider protrudes beyond said left side surface, so that said user may grasp said protruding portions of said slider and pull said slider rearward against said biasing means.

3. A detachable mount as recited in claim 2, wherein said protruding portions further comprise grip enhancing surfaces allowing said user to more easily grasp said protruding portions.

4. A detachable mount as recited in claim 1, wherein:

a. said notch comprises a downward facing surface, a rearward facing surface, and an upward facing surface, wherein said upward facing surface comprises a forward extreme and a rearward extreme, and wherein said upward facing surface is inclined from the horizontal so that said rearward extreme is lower than said forward extreme; and b. said slider has a forward portion and a rearward portion, and wherein said slider comprises a tapered surface located proximate said forward portion and facing generally downward, and wherein said tapered surface has a forward extreme and a rearward extreme, with said tapered surface being inclined from the horizontal so that said rearward extreme is lower than said forward extreme, so that when said slider is moved forward to engage said notch, said engagement is produced by said tapered surface on said slider bearing against said upward facing surface on said notch.

5. A detachable mount as recited in claim 1, wherein said front base and said rear base are made as one integral unit.

6. A detachable mount as recited in claim 1, wherein said scope mount is comprised of a front piece incorporating said front lug and a rear piece incorporating said rear lug.

7. A detachable mount as recited in claim 1, wherein said front lug within said front slot and said rear lug within said rear slot are free to move to a limited extent in a forward direction and a rearward direction with respect to said front base and said rear base, but are prevented from moving in a lateral direction, so that said scope mount moves forward and rearward with respect to said front mount and said rear mount as a result of recoil of said rifle, thereby reseating said detachable mount.

8. A detachable mount as recited in claim 4, wherein said front lug within said front slot and said rear lug within said rear slot are free to move to a limited extent in a forward direction and a rearward direction with respect to said front base and said rear base, but are prevented from moving in a lateral direction, so that said scope mount moves forward and rearward with respect to said front mount and said rear mount as a result of said user grasping said scope mount and pulling said scope mount rearward and forward, thereby reseating said detachable mount.

9. A detachable mount as recited in claim 1, wherein:

a. said upper surface in said front base opens into a second front slot;

b. said upper surface in said rear base opens into a second rear slot, wherein said second rear slot is bounded by a rearward facing wall and two lateral walls, with each of said walls having an upper and lower extreme, and wherein said rearward facing wall is inclined so that said upper extreme of said rearward facing wall is further from said rifle barrel than said lower extreme of said rearward facing wall;

c. said scope mount further comprises a second front lug and a second rear lug descending therefrom;

d. wherein said second front lug is sized to slidably fit within said second front slot and said second rear lug is sized to slidably fit within said second rear slot;

e. wherein said second rear lug has a forward facing surface having an upper extreme and a lower extreme, and wherein said forward facing surface is inclined so that said lower extreme is closer to said second front lug than said upper extreme; and f. wherein said second front lug has a rearward facing surface which opens into a notch sized to accommodate said slider, so that when said second front and second rear lugs are placed within said second front and second rear slots, and when said slider is moved forward toward said barrel, said slider engages said notch, thereby locking said second front lug within said front base, and said slider pushes said scope mount forward toward said barrel, thereby pushing said forward facing surface on said second rear lug against said rearward facing surface on said second rear slot, thereby locking said second rear lug within said rear base.

10. A detachable mount as recited in claim 1, further comprising a lanyard connecting said scope mount to said rifle by any conventional means.

11. A detachable mount is recited in claim 10, wherein said lanyard is detachable from said scope mount.

12. A detachable mount as recited in claim 10, where said lanyard is detachable from said rifle.

13. A detachable mount as recited in claim 1, further comprising spring means disposed between said front base and said scope mount, so that when said slider is moved away from said barrel, thereby disegaging from said notch in said front lug, said spring means biases says scope mount upward with respect to said front base so as to assist said user in removing said scope mount.

14. A detachable mount as recited in claim 13, wherein said front lug further comprises a lug rearward surface, and wherein said slider further comprises a slider forward surface, so that after said spring means biases said scope mount upward with respect to said front base, and after said user releases said slider, said at least one spring biasing said slider forward biases said slider forward, bringing said slider forward surface in firm contact with said lug rearward surface, thereby holding said scope mount in position until said user removes said scope mount.

* * * * *